US005929364A

United States Patent [19]

Tortorici et al.

[11] Patent Number: 5,929,364

[45] Date of Patent: Jul. 27, 1999

[54] OBTURATOR SEALING MEANS FOR A SPLIT WEDGE/BREECHBLOCK GUN

[75] Inventors: Richard W. Tortorici, Schenectady; Edward J. Hyland, Clifton Park, both of N.Y.

[73] Assignee: The United States of America as represented by the Secretary of the Army., Washington, D.C.

[21] Appl. No.: 08/977,570

[22] Filed: Nov. 25, 1997

Related U.S. Application Data

[60] Provisional application No. 60/059,721, Sep. 22, 1997, and provisional application No. 60/050,943, Jun. 6, 1997.

[51] Int. Cl.[6] ..... F41A 3/74

[52] U.S. Cl. ..... 89/26; 89/24

[58] Field of Search ..... 89/24, 26

[56] References Cited

U.S. PATENT DOCUMENTS 3,547,001 12/1970 Stoner ..... 89/156

4,022,104 5/1977 Politzer et al. ..... 89/26

5,054,366 10/1991 Bartolles ..... 89/26

FOREIGN PATENT DOCUMENTS 2361074 10/1975 Germany ..... 89/26

6873 of 1893 United Kingdom ..... 89/26

*Primary Examiner*—Stephen M. Johnson

*Attorney, Agent, or Firm*—John F. Moran; Michael C. Sachs

[57] ABSTRACT

An obturator for guarding the primary sealing surfaces of a step wedge breechblock gun from post-firing residue buildup assures greater survivability of the obturator without the necessity of cleaning after each firing. The device includes an active tube insert for facilitating face seal force multiplication, out of bore lip and face seals, an inbore piston polymer with expanding residue guard, and an out of bore face seal with a residue-tolerant polymer.

6 Claims, 3 Drawing Sheets

OBTURATOR SEALING MEANS FOR A SPLIT WEDGE/BREECHBLOCK GUN

This application claims benefit of the filing date of Jun. 6, 1997 of provisional application No. 60/050,943, now abandoned, and the filing date of Sep. 22, 1997 of provisional application No. 60/059,721, now abandoned.

GOVERNMENTAL INTEREST

The invention described herein may be manufactured, used and licensed by or for the U. S. Government for governmental purposes.

BACKGROUND OF THE INVENTION

Prior art large caliber cannon systems, such as the 155 mm, XM297, frequently experience chamber pressures between 5,000 and 25,000 psi with pressure impulse of 25 milliseconds. The XM297 utilizes a split wedge breechblock with a retentive bridge seal. This breechblock obturator has been described in the U.S. Pat. No. 5,589,656.

The problem with the aforementioned prior art retentive bridge seal was that it had a very short useful life. Post-firing residue buildup on the bridge seal necessitated the bridge seal to be removed from the breechblock and cleaned after each firing in order to insure continued performance of the gun and safety of the gun crew. Such rigid maintenance requirements under combat conditions would not be feasible, and severely limit the prior art gun system's effectiveness.

The present invention eliminates the necessity of frequently cleaning the breechblock obturator retentive bridge seal while retaining the advantages of the split/wedge breechblock concept.

SUMMARY OF THE INVENTION

The present invention relates to a split/wedge breechblock obturator which guards the primary sealing surface from post-firing residue buildup.

The present invention relates to a labyrinth obturator comprising an in-bore seal having a residue-tolerant polymer, a metal-to-metal lip seal which is out of bore, and a bore face seal with a residue-tolerant polymer.

An object of the present invention is to assure greater survivability of the obturator.

Another object of the present invention is to provide a split/wedge breechblock obturator having retentive seals which do not have to be cleaned after each gun firing.

Another object of the present invention is to provide a split/wedge breechblock obturator having sealing surfaces which are out of bore and protected from corrosive propellant gases.

Another object of the present invention is to provide a breechblock obturator wherein an out of bore face seal utilizes a 1.5 times force multiplication of the chamber pressure to assist in sealing the obturator to the gun tube.

A further object of the present invention is to provide a large caliber gun obturator which will withstand post-firing residue buildup, thereby assuring a greater survivability of the gun obturator.

For a better understanding of the present invention, together with other and further objects thereof, reference is made to the following descriptions taken in connection with the accompanying drawings.

BRIEF DESCRIPTION OF THE DRAWINGS

Throughout the following description, like numerals are used to denote like parts of the drawings.

DETAILED DESCRIPTION OF THE PREFERRED EMBODIMENTS

Figure 1:
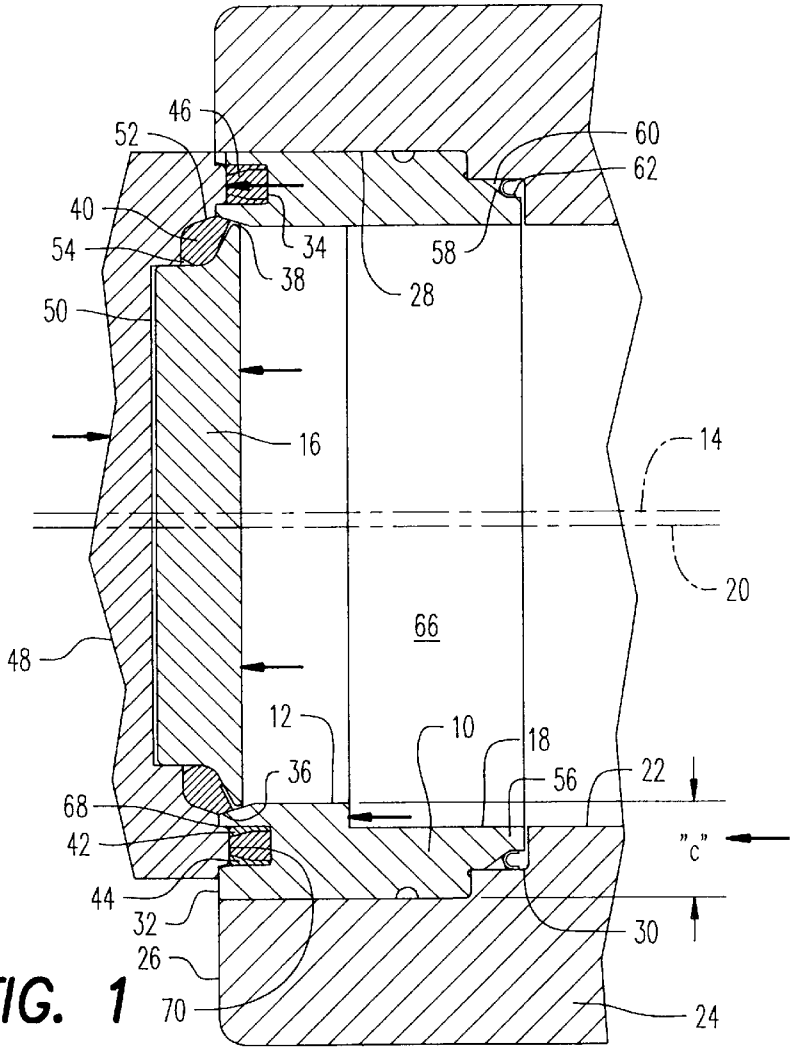
FIG. 1 is a partial diametral, longitudinal cross-section of the preferred embodiment showing the position of the breechblock parts after a propellant charge ignites.

Referring now to FIG. 1, the obturator shown is used in conjunction with a multidirectional breech having both vertical and horizontal motion. As aforementioned, U.S. Pat. No. 5,589,656 describes a split/wedge slide block breech having vertical and horizontal motion. The obturator sealing means of the present invention comprises a hollow cylindrical active tube insert member 10. Insert 10 has a rear bore 12 therein having centerline 14 axially aligned with a centerline of piston 16. A forward active tube insert bore 18 has a centerline 20 which is axially aligned with gun tube bore 22 of gun tube 24. Gun tube rear end 26 has a rear gun tube counter bore 28 therein and a smaller forward gun tube counter bore 30 connected thereto. The active tube insert bore 18 has a 2° diametral line to line fit to gun bore 22. The insert rear face 32 has an annular rectangular insert face seal groove 34 therein which is concentric with the rear active tube insert bore 12. Rear active tube insert bore 12 has a bore chamfer 36 therein for providing of sealing surface for an expanding piston metal guard ring 38 and a piston annular shaped residue-tolerant polymer 40. Face seal groove 34 operatively holds therein an inner ring 42 and an outer ring 44 with a face seal polymer 46 which 100% fills the cavity between inner ring 42 and outer ring 44. The face seal polymer 46 is captured between face seal inner ring 42 and face seal outer ring 44. Both inner and outer rings 42 and 44, respectively, have an interference fit with the active tube insert face seal groove 34. Step wedge 48 has a wedge piston bore 50 therein for slidably supporting piston 16. A wedge residue-tolerant polymer counterbore 52 helps to retain piston polymer 40. The piston polymer 40 is captured between the piston 16, step wedge 48, and the rear insert bore chamfer 36. A metal split ring 54 is operatively located intermediate piston 16, piston polymer 40 and wedge polymer counter bore 52. The metal split ring 54 has a slip fit to the piston 16 and is captured between the piston 16, step wedge 48 and piston polymer 40. Active tube insert forward end 56 has an outer chamfered surface 58 thereon for holding a metal wedge ring seal 60 and a "c" ring seal 62. The wedge ring seal 60 is in interference fit with gun tube 24. The metal "c" seal 62 is in interference fit with the gun tube 24 and the active tube insert forward end 56.

Figure 2:
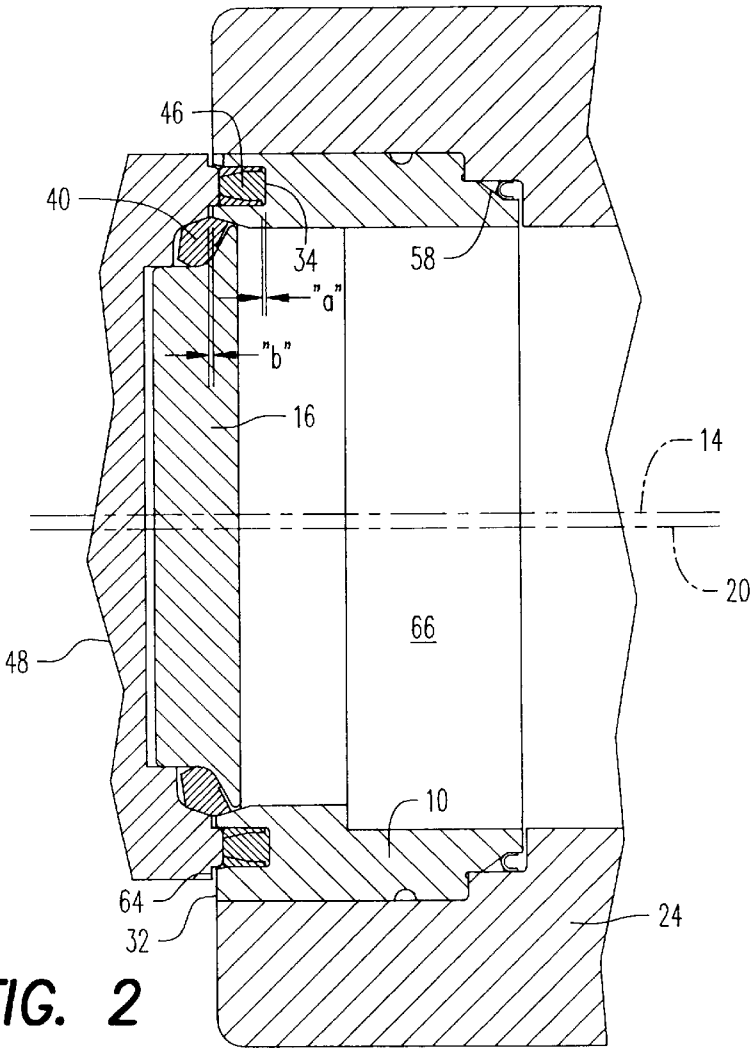
FIG. 2 is a partial diametral, longitudinal cross-section of the preferred embodiment showing how low pressure sealing is accomplished after closing of the breech and prior to propellant ignition.

Referring now to FIG. 2 which shows the preferred embodiment in an initial preload state. Under this initial preload condition, space "a" denotes the distance from the rear end of the inner and outer face seal rings 42 and 44, respectively, and the vertical inside surface of seal groove 34. It should be noted that face seal polymer 46 fills the cavity 100%. Space "b" is an initial preload condition which denotes the distance between active tube insert rear face 32 and step wedge face seal shoulder 64.

In operation, initial low pressure sealing is accomplished during closing of the breech as shown by FIG. 2. The piston polymer 40 and the face polymer 46 are sized to interfere with the closing of the breech by step wedge 48. The volume of the polymers 40 and 46 are equal to or slightly greater than the pockets provide. As the step wedge 48 pushes in a horizontal motion, the polymers 40 and 46 are compressed within the confines of the system. When the gun is fired, the charge, not shown, ignites, generating pressure in gun chamber 66 which acts on all projected areas as shown by the force arrows of FIG. 1. The gun chamber pressure pushes on piston 16 which creates a high hydrostatic pressure within piston polymer 40. The hydrostatic pressure is approximately one and one half times the gun chamber pressure. This forms an in bore expansion seal in the area of the expanding metal guard ring 38, and an out of bore seal at out of bore lip seal 68. The chamber pressure pushes on the active tube insert 10 against the insert's "net circumferential area" "c" causing the active tube insert to move against the annular boss shaped step wedge face seal 70 with great force. This force in turn creates a high hydrostatic pressure within the face seal polymer 46. Thus a face seal occurs between step wedge 48 and active tube insert 10.

Figure 4:
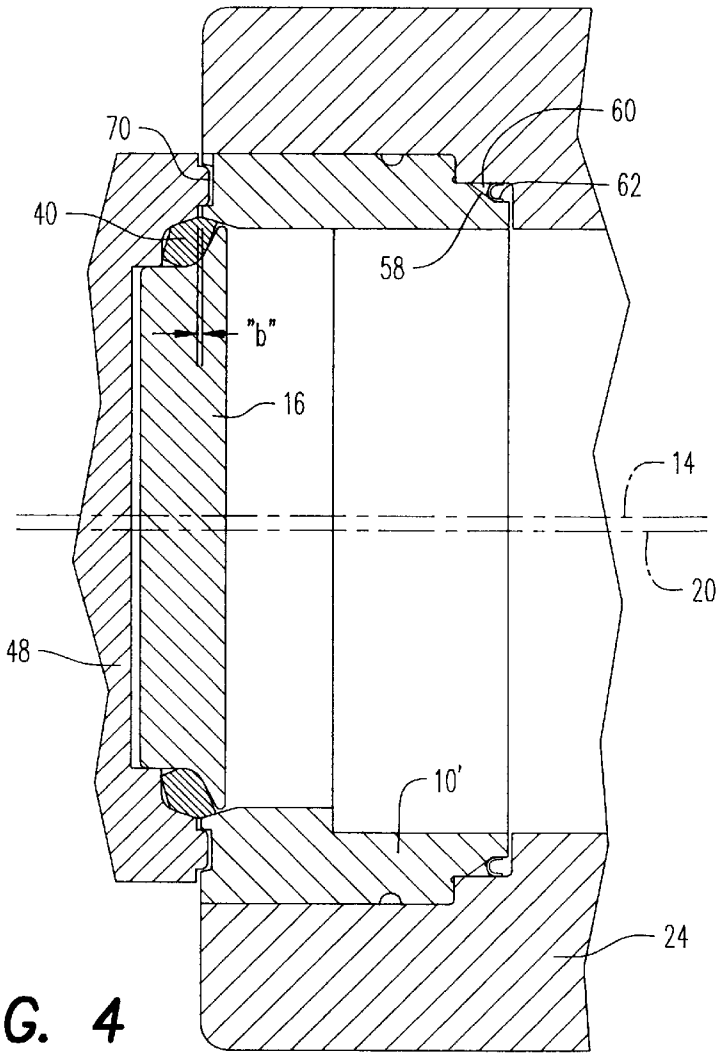
FIG. 4 is a diametral, longitudinal cross-section of the first alternate embodiment showing how low pressure sealing is accomplished after breech closing and prior to propellant ignition.
Figure 3:
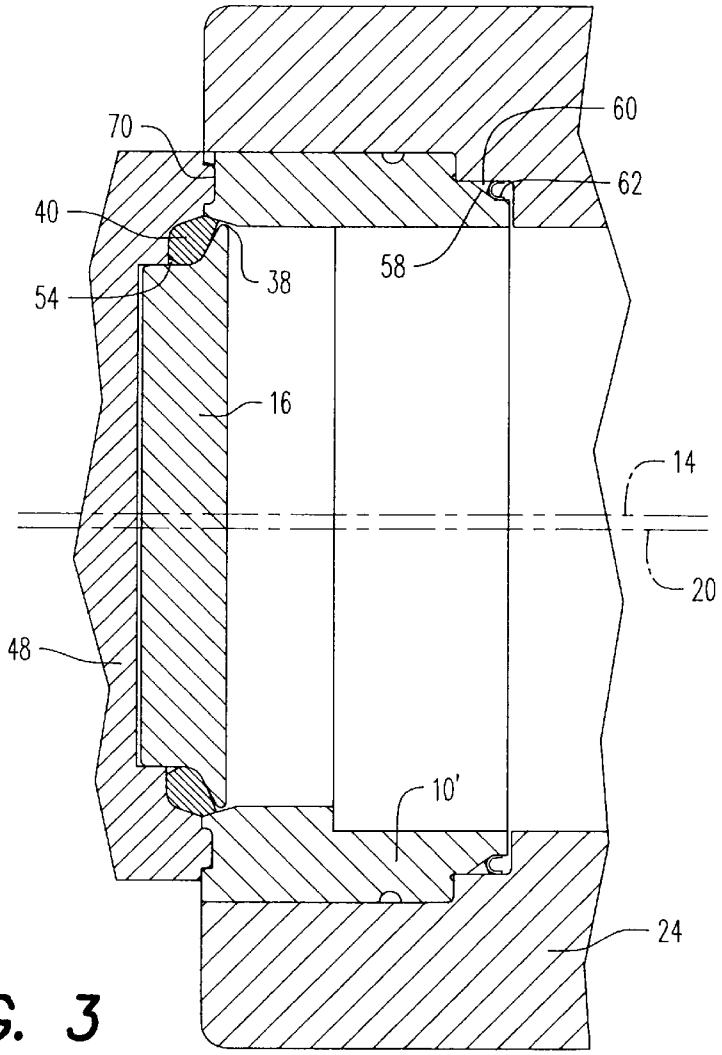
FIG. 3 is a partial diametral, longitudinal cross-section of a first alternate embodiment of the invention showing the position of the breechblock parts after propellant charge ignition.

Referring now to FIGS. 3 and 4, the alternate embodiment is similar to the aforedescribed preferred embodiment of FIGS. 1 and 2 with the exception of an active tube insert 10' which does not include a face seal polymer 46, inner and outer face seal rings 42 and 44, the tube insert face seal groove 34, and the initial preload space "a" of FIG. 2. This alternate embodiment of FIGS. 2 and 3 will withstand post-firing residue buildup, thus assuring a greater survivability of the gun obturator described in U.S. Pat. No. 5,589,656 of the XM297 gun system.

Figure 6:
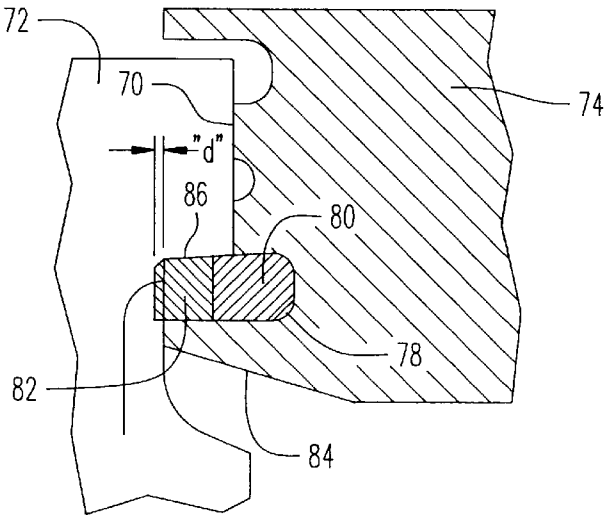
FIG. 6 is an enlarged partial cross-sectional view of the second alternate embodiment lip and face seal during initial preload condition after breech closing.
Figure 5:
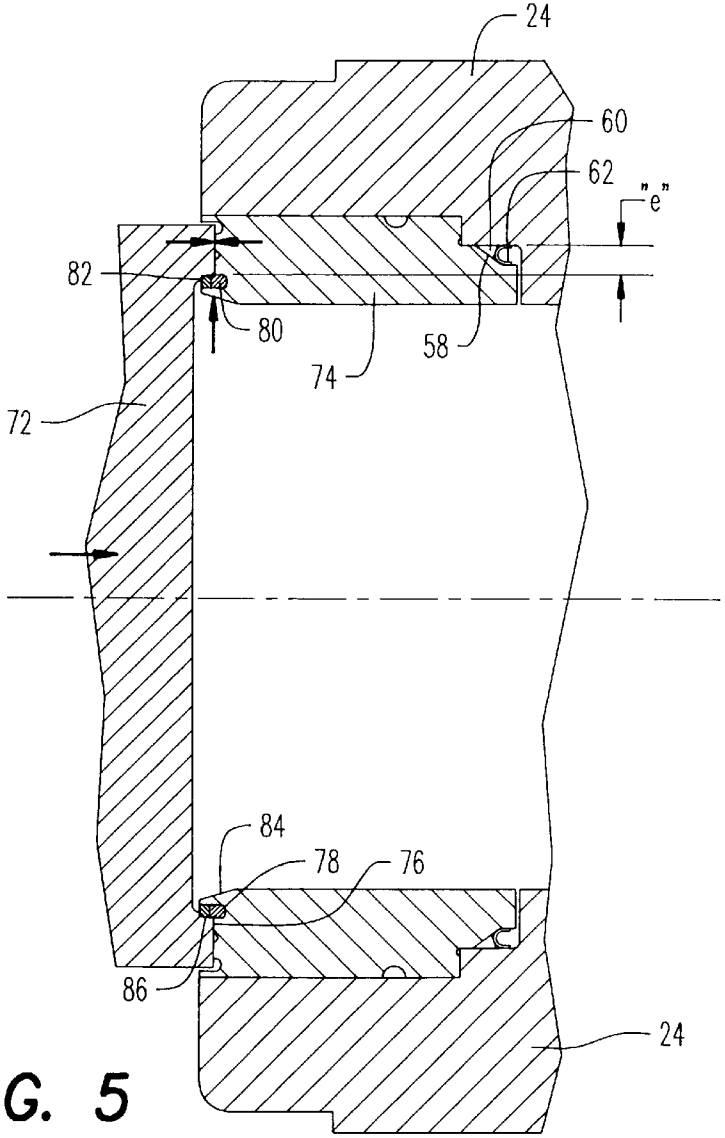
FIG. 5 is a partial diametral, longitudinal cross-section of the second alternate embodiment of the invention showing the position of the breechblock parts after propellant charge ignition.

Referring now to FIGS. 5 and 6, a second alternate embodiment of an active tube insert obturator is shown. This embodiment also comprises the use of an XM297 type split wedge 72, an active tube insert 74 having an annular metal wedge seal 60 and a metal "c" ring seal 62 located on the forward end thereof. Seals 60 and 62 function in the same manner aforedescribed in FIGS. 1–4 embodiments. The rear end of face 76 of the active tube insert 74 has an annular seal groove 78 for holding a polymer 80 therein which is in turn next to and protected by a metal guard ring 82. The metal guard ring 82 is in interference fit with the active tube insert 74 and operatively positioned intermediate active tube insert lip 84 and the inside lip 86 of step wedge 72. During the initial preload, the polymer 80 is sized to interfere with closing of the breach by the space "d" shown on FIG. 6. When the charge, not shown, ignites in the gun chamber, propellant gas forces indicated by arrows cause the metal guard 82 to push axially on polymer 80 as the lip 84 of the active tube insert 74 does the same radially. The active tube insert moves rearward against the net circumferential area indicated by the dimension "e". Active tube insert 74 moves against the face 70 of step wedge 72 at approximately 1.5 times the chamber pressure, thus producing an outbore labyrinth seal consisting of a "Face Seal" and a "Lip Seal."

While specific embodiments of the invention have been shown and described in detail to illustrate the application of the principles of the invention, it will be understood that the invention may be embodied otherwise without departing from such principles.

What is claimed is:

1. Obturator for a split wedge breechblock gun tube which comprises:

active tube insert means for pressure sealing a gun tube chamber after propellant ignition;

polymer means operatively positioned against said active tube insert means for providing a residue-tolerant polymer sealing surface between said active tube insert means and said split wedge breechblock;

metal ring means for retaining said polymer means in said active tube insert means;

lip sealing means for providing a seal between said split wedge breechblock and said active tube insert means;

face sealing means for providing a seal between said split wedge breechblock and said active tube insert means;

wedge ring sealing means operatively positioned intermediate a forward end of said active tube means and said gun tube for providing an inbore seal between said gun tube and said active tube insert means; and metal "c" ring seal means in juxtaposition with said wedge ring seal means, said active tube insert means and said gun tube, said metal "c" ring seal means when it becomes compressed providing an inbore seal between said gun tube and said active tube insert means.

2. Obtuator for a split wedge breechblock gun tube, including a face sealing means, as recited in claim 1 wherein said active tube insert means includes:

a face seal annular groove operatively positioned in a rear face of said active tube insert means;

an insert bore chamfer operatively positioned in a rear end of said active tube insert means, said face sealing means further comprising:

a face seal inner ring operatively located in said face seal annular groove;

a face seal outer ring operatively disposed in said face seal annular groove;

a face seal polymer (46) positioned intermediate said face seal inner ring and said face seal outer ring; and an annular shaped face seal boss means (70) on said split wedge breechblock (48), said boss means positioned oppositely from said face seal polymer of said active tube insert means whereby said face seal polymer when compressed by said boss means provides a means for face sealing.

3. Obtuator for a split wedge breechblock gun tube as recited in claim 2 which further includes:

piston means (16) operatively positioned in said split wedge breechblock (48) for sealing said gun tube chamber when said breachblock is in a closed position ready for firing, and for opening said gun chamber after firing;

expanding metal guard ring positioned intermediate said piston means and a rear active tube insert bore chamfer (36);

a piston polymer counter bore operatively positioned in said split wedge breechblock (48);

said metal ring means having a slip fit to said piston means, said metal ring means, said step wedges, and said polymer means.

4. Obturator as recited in claim 3 wherein said active tube insert face seal polymer (46) includes annularly shaped residue-tolerant face seal polymer material which completely fills said face seal annular groove.

5. Obturator as recited in claim 4 wherein said polymer means includes an annular shaped, residue-tolerant polymer that completely fills said piston counterbore when said breechblock is in a closed position ready for firing.

6. Obturator as recited in claim 5 wherein said active tube insert means (10) includes a net circumferential area "c" configuration, said pressure in said gun tube chamber pushing against said net circumferential area causing said active tube insert means to move against said face seal polymer (46) with great force, creating a hydrostatic pressure within said face polymer, thereby effecting a face seal.

* * * * *